US007325258B2

(12) United States Patent
Asada et al.

(10) Patent No.: US 7,325,258 B2
(45) Date of Patent: Feb. 5, 2008

(54) FLUSH TOILET

(75) Inventors: Kyoji Asada, Fukuoka (JP); Toshifumi Yoneda, Fukuoka (JP); Tomohiro Hirakawa, Fukuoka (JP)

(73) Assignee: Toto Ltd. (JP)

( * ) Notice: Subject to any disclaimer, the term of this patent is extended or adjusted under 35 U.S.C. 154(b) by 0 days.

(21) Appl. No.: 11/470,836

(22) Filed: Sep. 7, 2006

(65) Prior Publication Data

US 2007/0061955 A1 Mar. 22, 2007

Related U.S. Application Data

(63) Continuation of application No. PCT/JP2005/001343, filed on Jan. 31, 2005.

(30) Foreign Application Priority Data

Mar. 8, 2004 (JP) ..... 2004-063823

(51) Int. Cl.
*E03D 1/22* (2006.01)

(52) U.S. Cl. ..... 4/363; 4/425

(58) Field of Classification Search ..... 4/425, 4/422, 421, 364, 363

See application file for complete search history.

(56) References Cited

U.S. PATENT DOCUMENTS 4,462,124 A * 7/1984 Antos et al. ..... 4/346

FOREIGN PATENT DOCUMENTS

| | | |
|---|---|---|
| JP | 2129476 U | 3/1989 |
| JP | 07180202 | 7/1995 |
| JP | 09144096 | 6/1997 |
| JP | 2001254420 | 9/2001 |

* cited by examiner

*Primary Examiner*—Huyen Le
(74) *Attorney, Agent, or Firm*—Brooks Kushman P.C.

(57) ABSTRACT

Providing a flush toilet wherein the amount of water supplied to the jet hole and the amount of water supplied to the rim section are independently controlled. The present invention is a flush toilet (1) for supplying flushwater from a flushwater tank, the flush toilet comprising a bowl section (2) at the bottom portion of which is formed a jet hole; a jet flushwater tank (10) for storing flushwater to be supplied from the jet hole; a jet drain valve (14) disposed on the jet flushwater tank; a jet water conduit (18) for conducting flushwater which has passed through the jet drain valve to the jet hole; a rim section (4) disposed on the upper portion of the bowl section; a rim flushwater tank (8) for storing flushwater supplied to the rim section; a rim drain valve (12) disposed on the rim flushwater tank; and a rim water conduit (16) for conducting flushwater passed through the rim drain valve to the rim section.

8 Claims, 10 Drawing Sheets

(a)

(b)

FLUSH TOILET

CROSS-REFERENCE TO RELATED APPLICATIONS

This is a continuation of PCT International application no. PCT/JP2005/001343, with an international filing date of Jan. 31, 2005, which is incorporated by reference herein, which claims priority to JP 2004-063823, filed Mar. 8, 2004.

TECHNICAL FIELD

The present invention relates to a flush toilet, and more particularly to a flush toilet which supplies flushwater from a flushwater tank.

BACKGROUND ART

Tank-type flush toilets, in which flushwater supplied from a water main is collected in a flushwater tank, and a bowl section is cleaned by flushing with the flushwater in the tank, are widely used. In flush toilets of this type, in which the bowl section is cleaned by causing flushwater to be expelled from a rim section in the upper part of the bowl section and a jet hole, flushwater in the flushwater tank is divided and supplied to the rim section and to the jet hole. That is, when a drain valve disposed on the bottom portion of the flushwater tank is opened by a flushing operation, flushwater flows into a supply chamber formed on the main body of the flush toilet. The supply water chamber communicates with a rim water conduit and a jet water conduit; flushwater which has flowed into the supply water chamber branches and flows to the rim water conduit and the jet water conduit, supplying water to the rim and to the jet.

However, water conduits for supplying flushwater are complicated in flush toilets in which flushwater from a flushwater tank is caused to branch when being supplied, thus increasing flow path resistance in the water conduit. It is therefore necessary to make the water level of the flushwater stored in the flushwater tank sufficiently high that expelling of flushwater from the jet hole can be accomplished with sufficient water flow even if a loss of pressure in the water conduit occurs. "Low silhouette" type flush toilets are therefore difficult to implement in flush toilets of this type. In the present Specification, flush toilets in which the top surface of the tank is less than approximately 200 mm from the top surface of the rim section are referred to as low silhouette-type flush toilets.

A flush toilet comprising a water supply structure furnished with a jet drain valve for supplying water to a jet hole and a rim drain valve for supplying water to a rim section is set forth in Japanese Unexamined Patent Application Publication No. H7-180202 (Patent Ref. 1). In this toilet, the water conduit is simplified and water conduit fluid resistance is reduced by providing separate jet and rim drain valves.

Patent Reference 1: Unexamined Patent Application Publication No. H07-180202.

DISCLOSURE OF THE INVENTION

Problems Solved by the Present Invention

In the flush toilet set forth in Unexamined Patent Application Publication No. H07-180202, however, the supplying of water to the jet hole and to the rim section interfere with one another due to the disposition of two drain valves on a single flushwater tank, making it difficult to appropriately apportion the amount of water supplied to the jet hole and the amount of water supplied to the rim section. The problem is therefore presented that effective cleaning with a small amount of flushwater is difficult.

An additional problem with the flush toilet set forth in Unexamined Patent Application Publication No. H07-180202 is that the drain valve for the rim and the drain valve for the jet must be placed at positions which are at least higher than the jet hole on the rim section, making it difficult to design a low-silhouette type of flush toilet.

Accordingly, an object of the present invention is to provide a flush toilet wherein the amount of water supplied to the jet hole and the amount of water supplied to the rim section are independently controlled, thus enabling cleaning to be effectively performed with a small amount of flushwater.

A further object of the present invention is to provide a flush toilet with which a low silhouette-type flush toilet having a flushwater tank can be easily implemented.

The present invention is a flush toilet for supplying flushwater from a flushwater tank, the flush toilet comprising a bowl section at the bottom portion of which is formed a jet hole for expelling flushwater; a jet flushwater tank for storing flushwater to be supplied from the jet hole; a jet drain valve disposed on the jet flushwater tank for supplying and shutting off flushwater to the jet hole;

a jet water conduit for conducting flushwater which has passed through the jet drain valve to the jet hole; a rim section disposed on the upper portion of the bowl section for causing flushwater to flow down to the bowl section; a rim flushwater tank for storing flushwater supplied to the rim section; a rim drain valve disposed on the rim flushwater tank for supplying and shutting off flushwater to the rim section; and a rim water conduit for conducting flushwater passed through the rim drain valve to the rim section.

In the present invention thus constituted, flushwater expelled from the jet hole is supplied from the jet flushwater tank via a jet drain valve and a jet water conduit, while flushwater expelled from the rim section is supplied from the rim flushwater tank via the rim drain valve and the rim water conduit.

In the present invention thus constituted, the expulsion water amount and the timing of the commencement of expulsion. from the jet hole and from the rim section can be easily independently set.

In the present invention the rim drain valve is preferably disposed at a position higher than the height of the rim section top surface, and the jet drain valve is preferably disposed at a position lower than the rim section top surface and higher than the jet hole.

In the present invention thus constituted, the jet flushwater tank can be disposed at a position lower than the top surface of the rim section. Therefore the space below the rim section top surface can be used as a jet flushwater tank, thus enabling easy implementation of a low silhouette-shaped flush toilet.

The present invention further preferably comprises a supply valve constituted such that when the water level in a jet flushwater tank reaches a predetermined water level set to be lower than the rim section top surface height, supplying of water is stopped, and wherein the jet drain valve is disposed at a position lower than a predetermined water level.

In the present invention thus constituted, the supply of water to the interior of the jet flushwater tank is stopped at a water level below the height of the rim section top surface even if the jet drain valve stops closing for reasons such as a blockage of the flush toilet; hence flushwater will not pass over the rim section top surface from the bowl section and overflow. Fouling of floors, etc. in buildings where flush toilets are installed can thus be prevented.

The present invention further preferably comprises a transfer means for transferring the portion of flushwater exceeding a predetermined reservoir height from the rim flushwater tank to the jet flushwater tank when the water level in the rim flushwater tank surpasses the predetermined reservoir height, and a water supply valve constituted to supply water to the rim flushwater tank and to stop the supply of water when the jet flushwater tank water level reaches a predetermined water level set at a position lower than the height of the rim flushwater tank reservoir height.

In the present invention thus constituted, flushwater is first supplied to the rim flushwater tank via the water supply valve. The water level in the rim flushwater tank then rises, and when the water level surpasses a predetermined reservoir height, the portion of the flushwater supplied to the rim flushwater tank which surpasses the predetermined reservoir height is transferred to the jet flushwater tank by the transfer means. When the water level in the jet flushwater tank rises due to the transferred flushwater from the transfer means and reaches a predetermined water level, the water supply valve shuts off the supply of water.

The present invention thus constituted enables the water levels of the rim flushwater tank and the jet flushwater tank to be set by a single water supply valve.

In the present invention the rim flushwater tank is preferably disposed at a position higher than the jet flushwater tank, and the transfer means is a notch formed at the height of the rim flushwater tank, and wherein flushwater overflowing from this notch flows into the jet flushwater tank.

In the present invention thus constituted, the flushwater is supplied to the rim flushwater tank via a water supply valve; when the water level in the rim flushwater tank rises and surpasses a predetermined reservoir height, the flushwater passes through the notch and overflows to the rim flushwater tank.

The present invention thus constituted therefore enables transfer of flushwater in the rim flushwater tank to the jet flushwater tank, as well as accurate setting of the rim flushwater tank reservoir height.

In the present invention, the jet flushwater tank and the rim flushwater tank, as well as the bowl section, the jet water conduit, the rim section, and the rim water conduit are all preferably porcelain and form an integral unit. The present invention thus constituted permits low cost forming of the rim flushwater tank and the jet flushwater tank.

In the present invention, the jet flushwater tank is preferably constituted of porcelain, and the rim flushwater tank is constituted of resin.

In the present invention thus constituted, the rim flushwater tank is formed as a separate unit; therefore the rim flushwater tank can be positioned after parts to be installed on the jet flushwater tank are installed, thus improving ease of assembly of the toilet.

In the flush toilet of the present invention, the amounts of water supplied from the flushwater tank to the jet hole and to the rim section can be independently controlled.

REFERENCE NUMERALS

| | |
|---|---|
| 1 | First embodiment flush toilet of the present invention. |
| 2 | Bowl section |
| 4 | Rim section |
| 6 | Jet hole |
| 7 | Trap pipe |
| 8 | Rim flushwater tank |
| 10 | Jet flushwater tank |
| 12 | Rim drain valve |
| 14 | Jet drain valve |
| 16 | Rim water conduit |
| 18 | Jet water conduit |
| 20 | Second embodiment flush toilet of the present invention |
| 22 | Rim flushwater tank |
| 24 | Jet flushwater tank |
| 25 | Rim tank water supply valve |
| 26 | Jet tank water supply valve |
| 28a | Operating handle |
| 28b | Shaft |
| 30 | Third embodiment flush toilet of the present invention |
| 32 | Rim flushwater tank |
| 34 | Jet flushwater tank |
| 36 | Jet tank water supply valve |
| 38 | Notch |
| 40 | Water supply pipe |

PREFERRED EMBODIMENTS OF THE INVENTION

Following is an explanation of flush toilets embodying the present invention, with reference to attached drawings.

Figure 1:
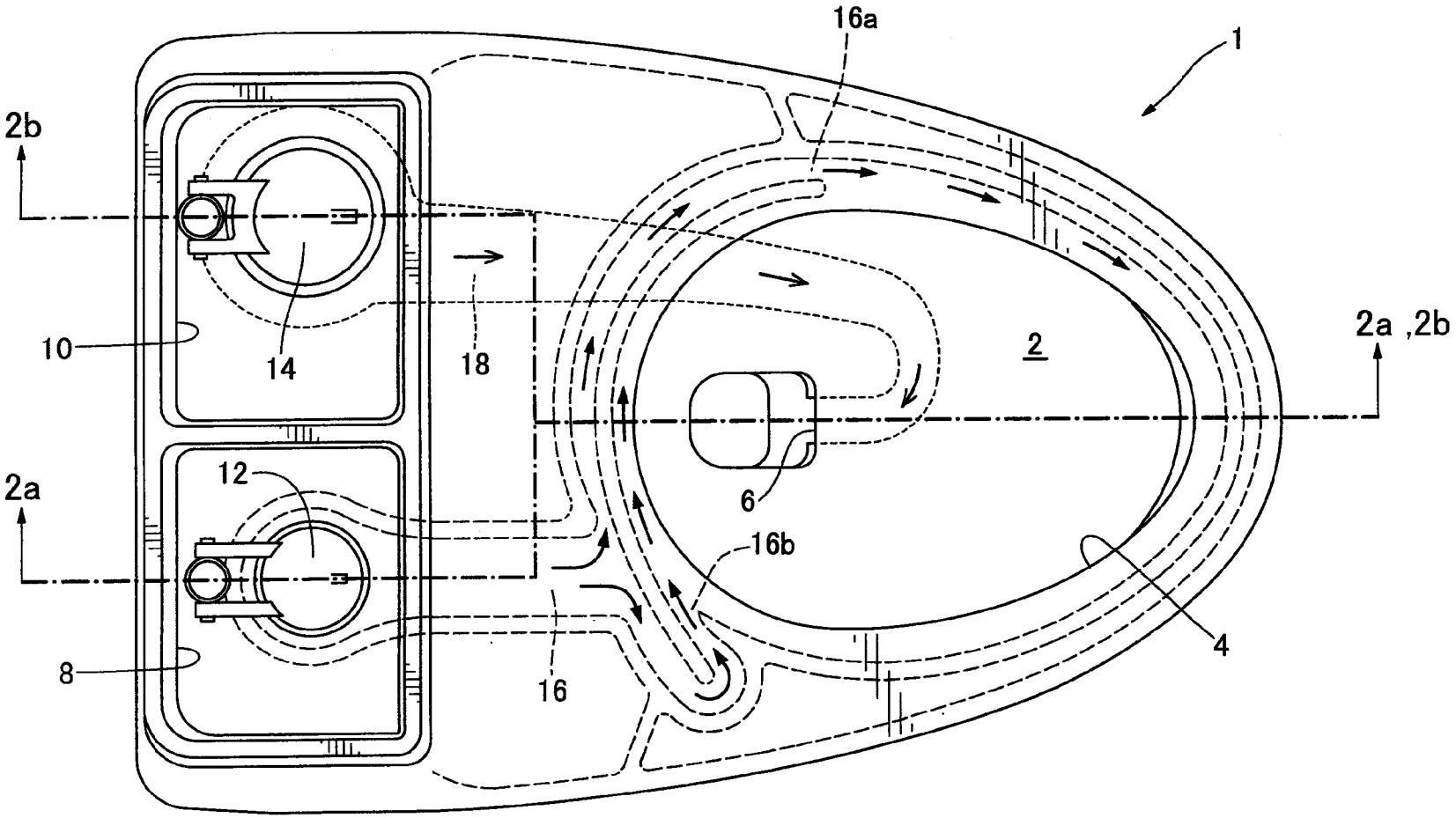
FIG. 1 is a top plan view of the first embodiment flush toilet of the present invention.
Figure 2:
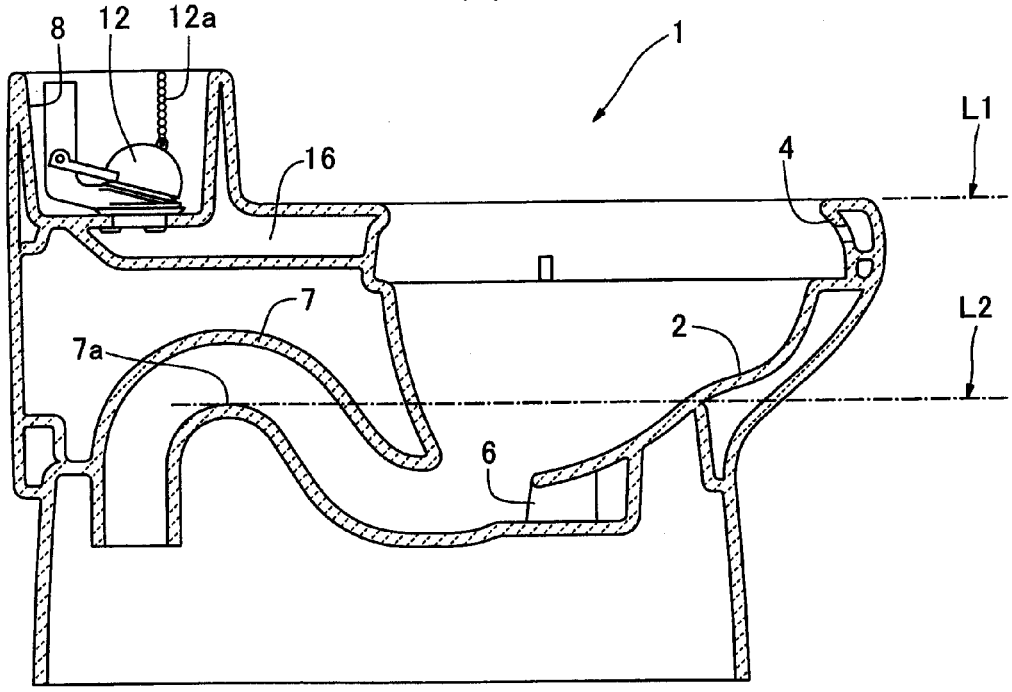
FIG. 2A is a side cross-sectional view taken along the line 2*a*-2*a* in FIG. 1.
FIG. 2B is a side cross-sectional view taken along the line 2*b*-2*b* in FIG. 1.
Figure 2:
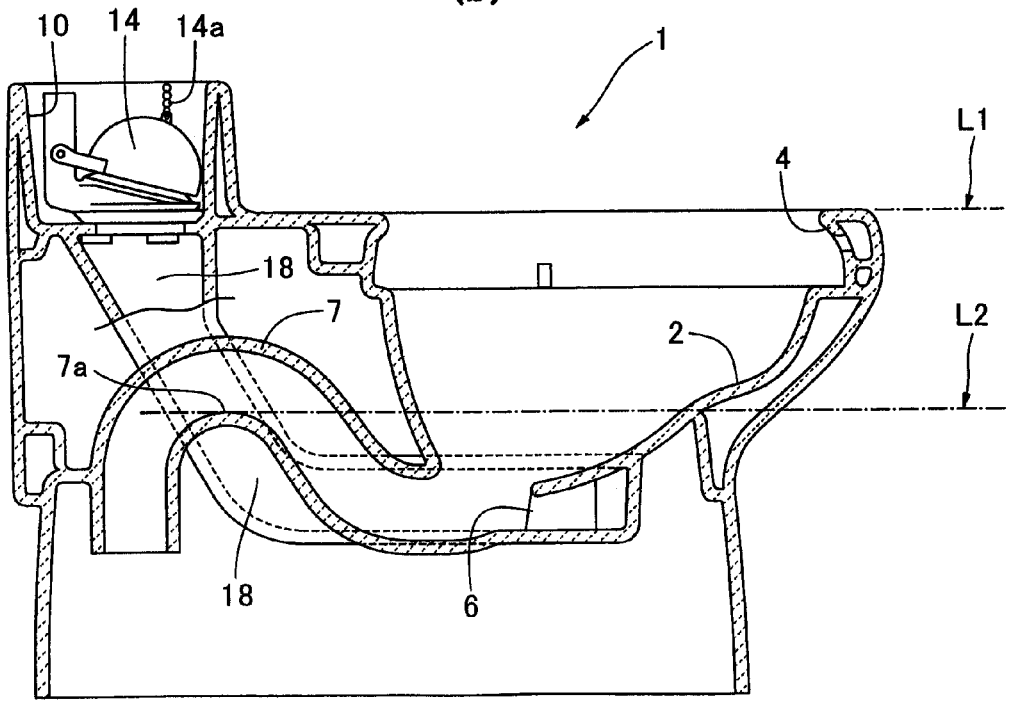

First, referring to FIGS. 1 through 3, a first embodiment flush toilet of the present invention will be explained. FIG. 1 depicts a top plan view of the first embodiment flush toilet of the present invention. FIG. 2(*a*) depicts a side cross-sectional view taken along the line 2*a*-2*a* in FIG. 1. FIG. 2(*b*) depicts a side cross-sectional view taken along the line 2*b*-2*b* in FIG. 1.

As shown in FIGS. 1 and 2, the first embodiment flush toilet of the present invention 1 comprises a bowl section 2, a rim section 4 formed at the perimeter of the top edge of the bowl section 2, a jet hole 6 formed at the bottom portion of the bowl section 2, and a trap pipe 7 communicating with the bottom portion of the bowl section 2 and connected to a drain pipe. Furthermore, the flush toilet 1 comprises a rim flushwater tank 8 which collects flushwater supplied to the rim section 4, a jet flushwater tank 10 which collects flushwater supplied to the jet hole 6, a rim drain valve 12 disposed on the rim flushwater tank 8, and a jet drain valve 14 disposed on the jet flushwater tank 10. The flush toilet 1 comprises a rim water conduit 16 which directs flushwater in the rim flushwater tank 8 to the rim section 4, and a jet water conduit 18 which directs flushwater in the jet flushwater tank 10 to the jet hole 6. In the present embodiment, the bowl section 2, the rim section 4, the jet hole 6, the trap pipe 7, the rim flushwater tank 8, the jet drain valve 14, the rim water conduit 16, and the jet water conduit 18 are formed of porcelain.

The bowl section 2 is formed in the front portion of the flush toilet 1; the rim section 4 is formed at the perimeter of the top edge opening thereof, and a jet hole 6 is formed at the bottom portion thereof, oriented toward the rear of the flush toilet 1. The trap pipe 7 is connected at the opposite side of the jet hole 6 on the bottom portion of the bowl section 2.

The rim section 4 is formed as a shelf-shaped water channel at the perimeter of the top edge opening portion of the bowl section 2. The rim section 4 is constituted so that the supplied flushwater flows downward into the bowl section 2 a little at a time as it passes through the shelf-shaped water channel and swirls, falling into the bottom portion of the bowl section 2 as it cleans the entire side wall of the bowl section 2. The "rim section" in the present Specification refers to various structures in which flushwater is flushed from above to clean a bowl section, such as a shelf-shaped water channel like that of the present embodiment, whereby the bowl section is cleaned by creating a spiral flow, or a "box rim," in which a plurality of water jet holes are disposed on the bottom wall surface of a box-shaped water duct, etc. The "rim top surface" is the top edge surface of the rim section, and refers to the surface which is overflowed by flushwater from the bowl section when the water level in the bowl section rises above a height L1 therein.

The trap pipe 7 is constituted to communicate with the bottom portion of the bowl section 2 and extend from the bowl section 2 rearward. The trap pipe 7 extends diagonally upward from the bottom portion of the bowl section 2, passes through an apex 7*a* at a height L2, which is the highest point on the trap pipe 7, then extends vertically downward. The trap pipe 7 outlet is connected to a drain pipe (not shown) provided in the floor.

The rim flushwater tank 8 is formed at the back of the flush toilet 1. The rim flushwater tank 8 is placed at a position such that its bottom surface is higher than the shelf-shaped surface of the rim section 4. The rim drain valve 12 is disposed on the bottom surface of the rim flushwater tank 8. The rim water conduit 16 is formed on the bottom side of the rim drain valve 12; water which has passed through the rim drain valve 12 flows into the rim water conduit 16. The rim water conduit 16 is formed to extend frontward approximately horizontally from the lower portion of the rim flushwater tank 8 toward the bowl section 2, branching to the left and right in the vicinity of the bowl section 2 edge portion. One of the branched rim water conduits 16 communicates with a first rim water spout 16*a*; the other rim water conduit 16 communicates with a second rim water spout 16*b*. The first rim water spout 16*a* opens toward the front on the side portion of the bowl section 2; the second rim water spout 16*b* opens toward the rear on the rear side portion of the bowl section 2 on the side opposite the first rim water spout 16*a*.

The jet flushwater tank 10 is formed to be larger than the rim flushwater tank 8 at the rear of the flush toilet 1. The jet flushwater tank 10 is placed in a position whereby its bottom surface is higher than the rim section 4 shelf-shaped surface. The jet drain valve 14 is formed to be larger than the rim drain valve 12. The jet water conduit 18 is formed at the bottom side of the jet drain valve 14; flushwater which has passed through the jet drain valve 14 flows into the jet water conduit 18 and is expelled from the jet hole 6. The jet water conduit 18 is formed to extend from the lower portion of the jet drain valve 14 diagonally downward toward the front, making a U-turn to communicate with the rearward-opening jet hole 6.

Also, beaded chains 12*a* and 14*a* are respectively connected to the rim drain valve 12 and the jet drain valve 14. When a user performs a flush operation on the flush toilet 1, the beaded chains 12*a* and 14*a* are pulled up by a drain valve operating mechanism (not shown), respectively opening the rim drain valve 12 and the jet drain valve 14.

Next, referring to FIGS. 1 through 3, the operation of the first embodiment flush toilet 1 of the present invention will be explained. FIG. 3 is a diagram depicting the timing of the opening of the rim drain valve 12 and the jet drain valve 14 when a user of the flush toilet 1 performs a flushing operation.

First, in a state in which no flushing operation is being performed, flushwater collects up to the height of the trap pipe 7 apex 7*a* in the flush toilet 1 bowl section 2, as depicted in FIGS. 2(*a*) and (*b*). Also, flushwater is stored up to a predetermined water level in the rim flushwater tank 8 and the jet flushwater tank 10. Next, when the flush toilet 1 user performs a flushing operation, the beaded chains 12*a* and 14*a*, connected by a drain valve operating mechanism (not shown) to each drain valve, are respectively lifted up, thereby causing the rim drain valve 12 and the jet drain valve 14 also to be lifted, such that each drain valve is opened. Here the beaded chain 14*a* connected to the jet drain valve 14 is made to be longer than the beaded chain 12*a* connected to the rim drain valve 12. Therefore when the beaded chains 12*a* and 14*a* are simultaneously raised by a flushing operation, the rim drain valve 12 is first opened and then, after a slight delay, the jet drain valve 14 is opened, as shown in FIG. 3.

First, flushwater flows into the rim water conduit 16 from the rim flushwater tank 8 when the rim drain valve 12 is opened, and is respectively expelled from the first rim water spout 16*a* and the second rim water spout 16*b*. The flushwater respectively expelled from the first rim water spout 16*a* and second rim water spout 16*b* passes over the rim and swirls inside the bowl section 2, flowing into the bottom portion of the bowl section 2 as it cleans the side walls of the bowl section 2. Waste and the like floating in the water in the bowl section 2 is gathered at the center of the bowl section 2 by the flow of the flushwater from the rim section 4.

When the jet drain valve 14 is opened slightly after the opening of the rim drain valve 12, the flushwater in the jet flushwater tank 10 flows into the jet water conduit 18 and is expelled from the jet hole 6. When the flushwater flows into the bowl section 2 from the rim section 4 and the jet hole 6 such that the bowl section 2 water level rises, the flushwater surpasses the trap pipe 7 apex 7*a* and is discharged toward a drain pipe (not shown). When this flow causes the flushwater to fill the trap pipe 7, the flushwater in the bowl section 2 is suctioned toward the trap pipe 7 by the siphon effect.

Waste which had sunk to the bottom portion of the bowl section 2 and floating waste gathered at the center portion of the bowl section 2 are thus suctioned together with the flushwater and discharged to the drain pipe (not shown) through the trap pipe 7.

Figure 3:
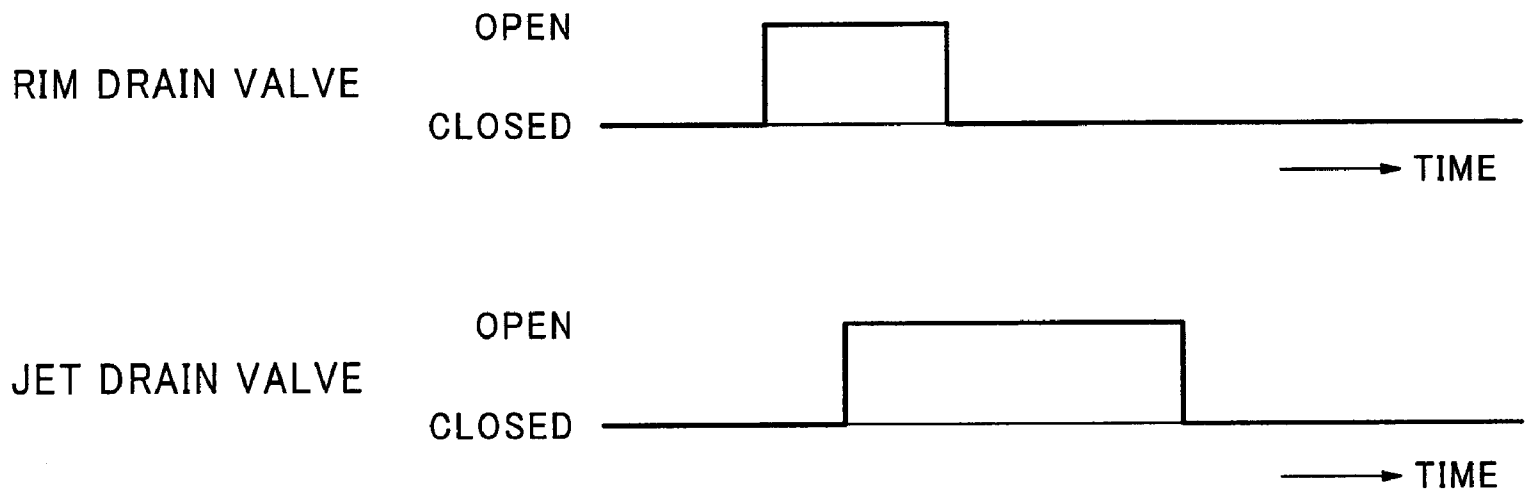
FIG. 3 is a graph depicting the timing at which a rim drain valve and a jet drain valve are opened when a flush operation is performed.

When the flushwater in the rim flushwater tank 8 is discharged through the opened rim drain valve 12 and the flushwater in the rim water conduit 16 disappears, the rim drain valve 12 ceases to be buoyant, so the rim drain valve 12 is closed by gravity, as shown in FIG. 3. Next, when the flushwater in the jet flushwater tank 10 is discharged through the opened jet drain valve 14, the jet drain valve 14 also closes. In the present embodiment, the jet flushwater tank 10 is formed to be larger than the rim flushwater tank 8, and a long time period is required to discharge the flushwater in the jet flushwater tank 10; therefore, as shown in FIG. 3, the jet drain valve 14 closes after being opened for a longer period of time than the rim drain valve 12.

After the siphon operation ends, the water level in the bowl section 2 rises due to the inflow to the bowl section 2 of flushwater from the jet hole 6 and the rim section 4, and the initial water level is restored, as shown in FIG. 2. Also, new flushwater is supplied from the water main via a water supply valve (not shown) to the rim flushwater tank 8 and the jet flushwater tank 10, respectively. When the water level in the rim flushwater tank 8 and the water level in the jet flushwater tank 10 respectively reach a predetermined water level, the water supply valve is shut off, thus completing one flush operation.

According to the first embodiment flush toilet 1 of the present invention, the rim flushwater tank for supplying water to the rim and the jet flushwater tank for supplying water to the jet are independently provided; therefore the amount of water expelled from the rim section and the amount of water expelled from the jet hole can be freely set. It is thus possible to freely set the timing at which each drain valve is opened, the flushwater flow quantity per unit time from the rim section and the jet hole, and the duration of flushwater expulsion to fit the characteristics of the flush toilet main unit for more effective cleaning, thereby enabling efficient cleaning without the use of wasteful amounts of water.

Next, referring to FIG. 4 and FIG. 5, a second embodiment flush toilet of the present invention will be explained. In the second embodiment flush toilet of the present invention, the placement of the jet flushwater tank, the rim flushwater tank, and each of the drain valves disposed thereon differs from the first embodiment. Therefore only those points of the flush toilet of the present embodiment which differ from the first embodiment will be explained. The same reference numerals are assigned to portions having the same constitution, and an explanation of those portions is omitted.

Figure 4:
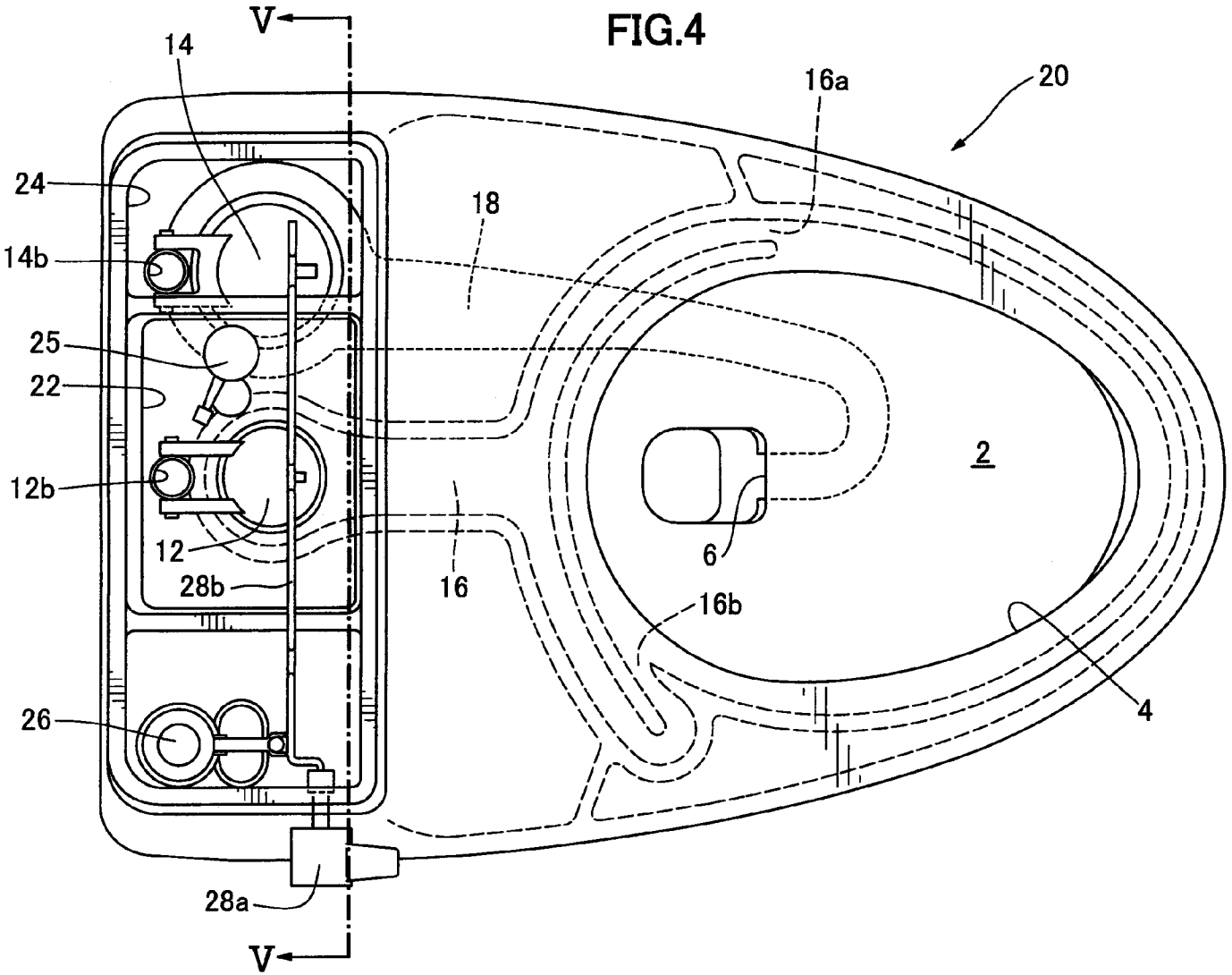
FIG. 4 is a top plan view of the second embodiment flush toilet of the present invention.
Figure 5:
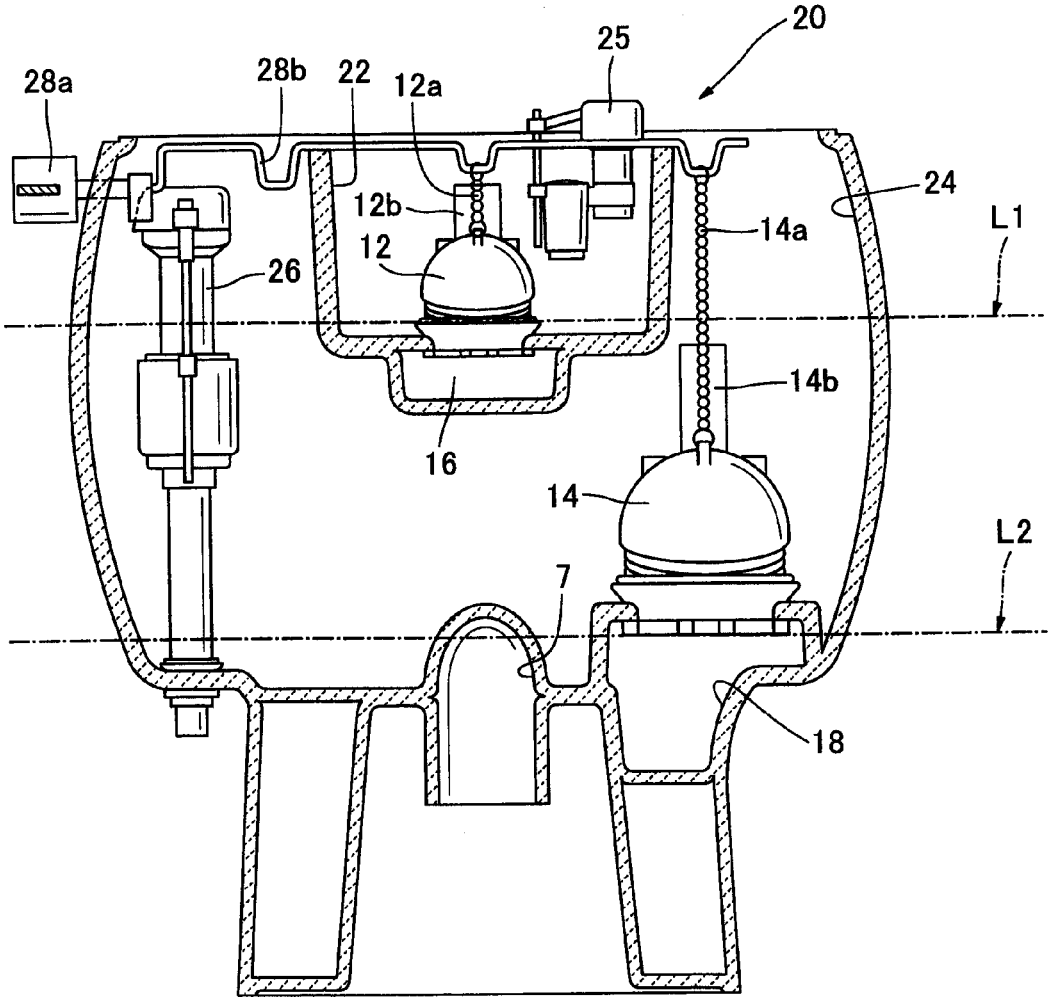
FIG. 5 is a cross-sectional view taken along the line V-V in FIG. 4.

FIG. 4 is a top plan view of the second embodiment flush toilet of the present invention; FIG. 5 is a section taken along the line V-V in FIG. 4. As shown in FIGS. 4 and 5, the second embodiment flush toilet 20 of the present invention comprises a bowl section 2, a jet hole 6, and a trap pipe 7. The flush toilet 20 further comprises a rim flushwater tank 22 for holding flushwater supplied to the rim section 4, a jet flushwater tank 24 for holding flushwater supplied to the jet hole 6, a rim drain valve 12 disposed on the rim flushwater tank 22, and a jet drain valve 14 disposed on the jet flushwater tank 24. The flush toilet 20 also comprises a rim water conduit 16 which conducts the flushwater in the rim flushwater tank 22 to the rim section 4, and a jet water conduit 18 which conducts the flushwater in the jet flushwater tank 24 to the jet hole 6. Also, in the present embodiment the bowl section 2, the rim section 4, the jet hole 6, the trap pipe 7, the rim flushwater tank 22, the jet flushwater tank 24, the rim water conduit 16 and the jet water conduit 18 are formed as an integral unit of porcelain.

The rim flushwater tank 22 is formed at the center rear portion of the flush toilet 20. The rim flushwater tank 22 is positioned such that its bottom surface is at approximately the same height as the height L1 of the top surface of the rim section 4. A rim drain valve 12 is disposed on the bottom surface of the rim flushwater tank 22 at a position slightly higher than height L1. A rim water conduit 16 is formed on the bottom side of the rim drain valve 12; flushwater which has passed through the rim drain valve 12 flows into the rim water conduit 16. The rim water conduit 16 is formed to extend from the rim flushwater tank 22 lower portion frontward approximately horizontally toward the bowl section 2, branching to the left and right in the vicinity of the edge of the bowl section 2. One of the branched rim water conduits 16 communicates with the first rim water spout 16*a*; the other rim water conduit 16 communicates with the second rim water spout 16*b*.

The jet flushwater tank 24 is positioned at the rear of the flush toilet 20 and on the bottom side of the rim flushwater tank 22. The jet flushwater tank 24 capacity is formed to be larger than the rim flushwater tank 22. The jet drain valve 14 is disposed inside the jet flushwater tank 24; the jet drain valve 14 is placed in a position lower than the height L1 and higher than the height L2 of the trap pipe 7 apex. In order to supply flushwater in large instantaneous flow quantities to the jet hole 6, the jet drain valve 14 is formed to be larger than the rim drain valve 12. The jet water conduit 18 is formed on the bottom side of the jet drain valve 14; flushwater which has passed through the jet drain valve 14 flows into the jet water conduit 18 and is expelled from the jet hole 6.

Also, a rim tank water supply valve 25 is formed inside the rim flushwater tank 22. The rim tank water supply valve 25 is constituted to supply flushwater to the rim flushwater tank 22 until the water level in the rim flushwater tank 22 reaches a predetermined water level. Furthermore, a jet tank water supply valve 26 is positioned inside the jet flushwater tank 24. The jet tank water supply valve 26 is constituted to supply flushwater to the jet flushwater tank 24 until the water level in the jet flushwater tank 24 reaches a predetermined water level set to be lower than the height L1 of the top surface of the rim section 4.

Also, an operating handle 28*a* to enable the user to perform a flushing operation is rotatably attached on the upper side surface of the jet flushwater tank 24. Furthermore, a shaft 28*b* bent in a crank shape is rotatably attached at the upper portion of the jet flushwater tank 24 so as to traverse the jet flushwater tank 24. The operating handle 28*a* and the shaft 28*b* are constituted such that when a user turns and operates the operating handle 28*a*, the shaft 28*b* is also turned, thereby comprising a drain valve operating mechanism.

Beaded chains 12*a* and 14*a* are respectively connected to the rim drain valve 12 and the jet drain valve 14. The other ends of these beaded chains 12*a* and 14*a* are connected to the crank portion of the shaft 28*b* positioned on the upper portion of the jet flushwater tank 24. Therefore when the shaft 28*b* is turned and operated, the beaded chains 12*a* and 14*a* are lifted upward and the rim drain valve 12 and jet drain valve 14 are respectively opened.

Furthermore, overflow pipes 12*b* and 14*b* are provided adjacent to the rim drain valve 12 and jet drain valve 14. By so doing, when the water level inside the rim flushwater tank 22 or the jet flushwater tank 24 surpasses a predetermined set water level due to trouble with the water supply valve or the like, the flushwater in the tank bypasses each of the drain valves and is discharged into the bowl section 2 through the overflow pipes 12*b* and 14*b*.

Next the operation of the second embodiment flush toilet 20 of the present invention will be explained. First, in a state in which no flushing operation is being performed, flushwater collects in the flush toilet 20 bowl section 2 up to the height L2 of the trap pipe 7 apex 7*a*. Also, flushwater is stored up to a predetermined water level in the rim flushwater tank 22 and the jet flushwater tank 24. Next, when the flush toilet 20 user turns the operating handle 28*a* to perform a flushing operation, the shaft 28*b* also turns. When the shaft 28*b* is turned the beaded chains 12*a* and 14*a* linked to the shaft 28*b* are respectively lifted up, causing the rim drain valve 12 and the jet drain valve 14 also to be lifted up and each of the drain valves to open. The timing at which each drain valve is opened can be freely set by the length of the beaded chains 12*a* and 14*a* and the length and angle of the crank portion formed on the shaft 28*b*.

The bowl section cleaning operation after the rim drain valve 12 and the jet drain valve 14 are opened is similar to the first embodiment; an explanation thereof is therefore omitted.

After the cleansing operation is completed, new flushwater is supplied from the water main to the rim flushwater tank 22 and the jet flushwater tank 24, respectively, via the rim tank water supply valves 25 and 26; each water supply valve is closed when the water level in the rim flushwater tank 22 and the water level in the jet flushwater tank 24 respectively reach a predetermined water level, thus completing one flush operation.

Because the rim flushwater tank 22 and the rim drain valve 12 are placed in positions higher than the first rim water spout 16*a* and the second rim water spout 16*b*, the rim flushwater tank 22 flushwater is expelled from each rim expulsion port at a water pressure corresponding to the head differential between each of the rim spout ports and the water level in the rim flushwater tank 22. Because the rim drain valve 12 is placed at a position higher than the rim section top surface height L1, the rim drain valve 12 will also be reliably closed in cases in which for some reason the water level of the flushwater in the bowl section 2 rises to the vicinity of the rim section top surface. By so doing, the rim drain valve 12 remains open after the cleansing operation; the flushwater supplied to the rim flushwater tank 22 flows into the bowl section 2 without causing the bowl section 2 to overflow, and fouling of the building in which the flush toilet is installed can be prevented.

Also, because the jet flushwater tank 24 is placed in a position higher than the jet hole 6, the flushwater in the jet flushwater tank 24 is expelled from the jet hole 6 at a water pressure corresponding to the head differential between the jet hole 6 and the water level in the jet flushwater tank 24. Moreover, the jet flushwater tank 24 is placed at a position lower than the rim flushwater tank 22 and the rim section top surface height L1; therefore the space on the underside of the rim section top surface can be used as a flushwater tank, thus enabling easy implementation of a low silhouette tank-type toilet. By setting the water level at which flushwater is stored in the jet flushwater tank 24 to be lower than the rim section upper surface height L1, the flushwater stored in the jet flushwater tank 24 can be prevented from overflowing the bowl section 2, and fouling of the building in which the toilet is installed can be avoided.

The second embodiment of the present invention enables easy implementation of a low silhouette-type flush toilet for tank-type toilets in which both the rim section and the jet hole are supplied with flushwater.

In the embodiments described above, each drain valve was opened by lifting up it using a beaded chain linked to a drain valve operating mechanism. As a variation, each drain valve could also be opened by lifting up beaded chains linked to each drain valve using electrically driven actuators. Such a constitution enables freer setting of the timing at which each drain valve is opened and closed. Alternatively, electrically operated solenoids could also be used for each drain valve.

Next, referring to FIGS. 6 and 7, a third embodiment flush toilet of the present invention will be explained. The mechanism for supplying water to the jet flushwater tank and the rim flushwater tank in the third embodiment flush toilet of the present invention differs from the second embodiment. Only the points which differ from the first and second embodiments will be explained; the same reference numerals are assigned to portions having the same constitution, and explanation of those portions is omitted.

Figure 6:
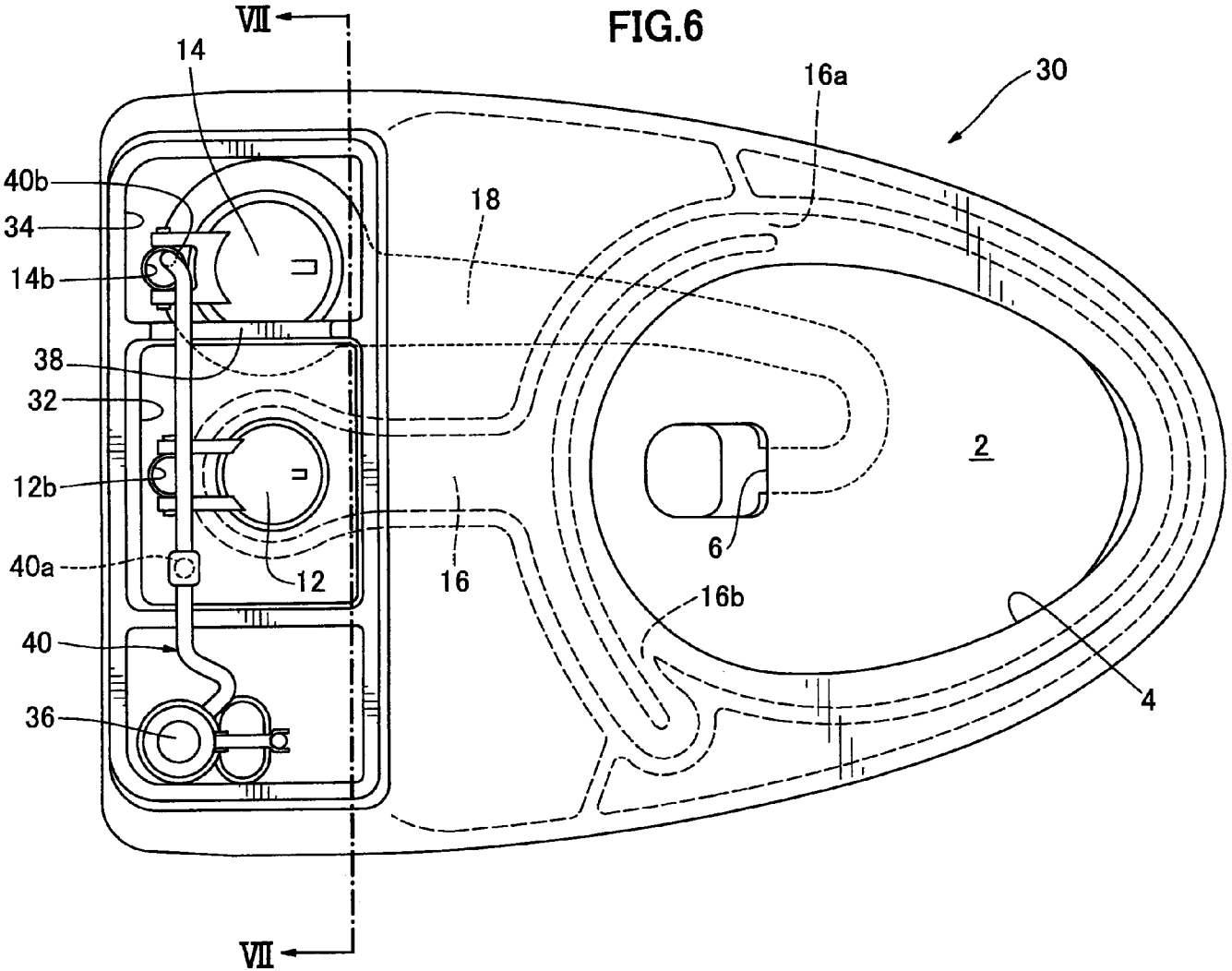
FIG. 6 is a top plan view of the third embodiment flush toilet of the present invention.
Figure 7:
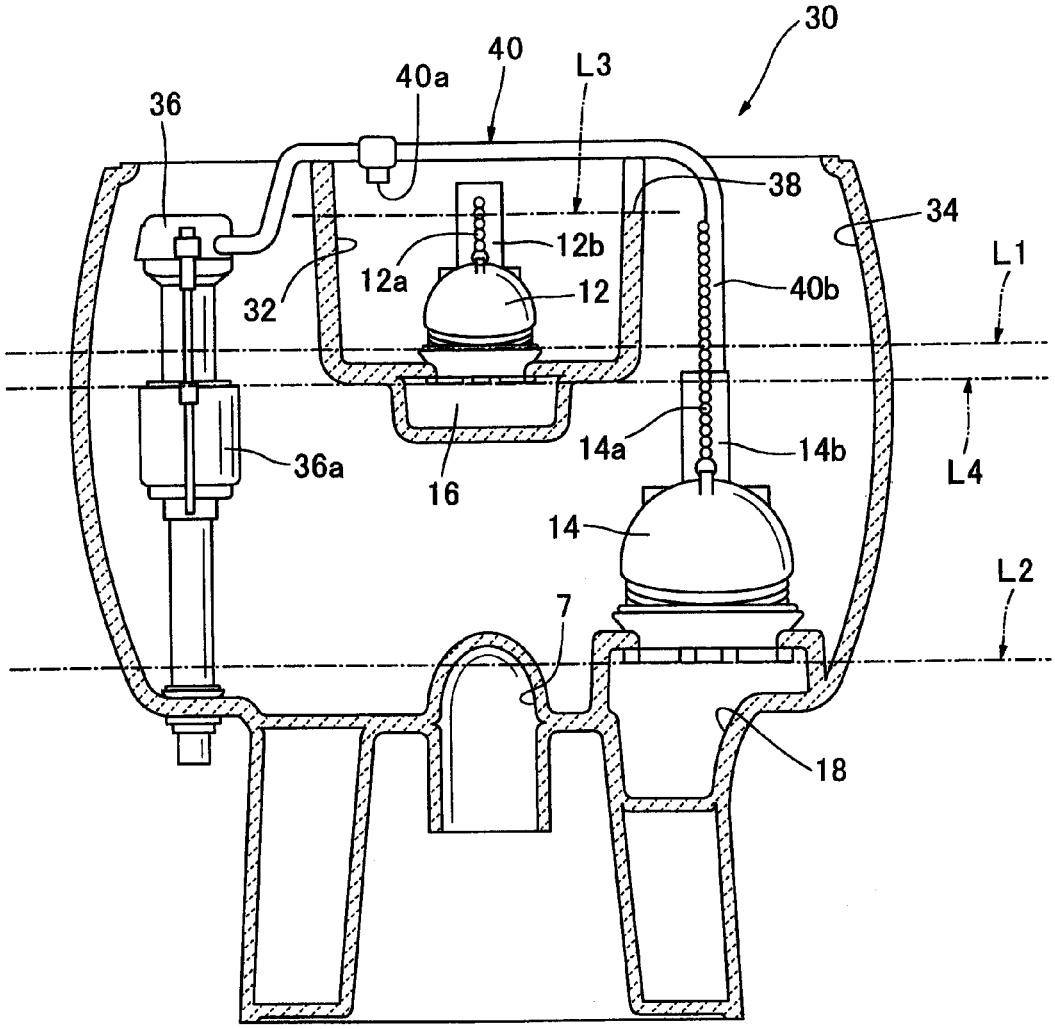
FIG. 7 is a cross-sectional view taken along the line VII-VII in FIG. 6.

FIG. 6 is a top plan view of the third embodiment flush toilet of the present invention; FIG. 7 is a section taken along the line VII-VII in FIG. 6. As shown in FIGS. 6 and 7, the third embodiment flush toilet 30 of the present invention comprises a bowl section 2, a rim section 4, a jet hole 6, and a trap pipe 7. Furthermore, the flush toilet 30 comprises a rim flushwater tank 32 for holding flushwater, a jet flushwater tank 34 for holding flushwater supplied to the jet hole 6, a rim drain valve 12 disposed on the rim flushwater tank 32, and a jet drain valve 14 disposed on the jet flushwater tank 34. The flush toilet 30 also comprises a rim water conduit 16 to conduct the flushwater in the rim flushwater tank 32 to the rim section 4, and a jet water conduit 18 to conduct the flushwater in the jet flushwater tank 34 to the jet hole 6. In the present embodiment, the bowl section 2, the rim section 4, the jet hole 6, the trap pipe 7, the rim flushwater tank 32, the jet flushwater tank 34, the rim water conduit 16 and the jet water conduit 18 are formed of porcelain. Furthermore, a notch 38, which is a transfer means for transferring flushwater supplied to the rim flushwater tank 32 to the jet flushwater tank 34, is formed on the rim flushwater tank 32.

The rim flush water tank 32 is formed at the rear center portion of the flush toilet 30. The rim flushwater tank 32 is placed such that the bottom surface thereof is at approximately the same height as the height L1 of the rim section 4 top surface. A notch 38 is formed on one side wall surface of the rim flushwater tank 32 at a height L3 position, and is constituted such that when the water level in the rim flushwater tank 32 surpasses the height L3, the flushwater overflowing the rim flushwater tank 32 flows through the notch 38 into the jet flushwater tank 34 disposed below. A rim drain valve 12 is provided on the bottom surface of the rim flushwater tank 32 at a position slightly higher than height L1. The rim water conduit 16 is formed on the bottom side of the rim drain valve 12; flushwater which has passed through the rim drain valve 12 flows into the rim water conduit 16. The rim water conduit 16 is formed to extend from the lower portion of the rim flushwater tank 32 frontward approximately horizontally toward the bowl section 2, branching to the left and right in the vicinity of the bowl section 2 edge portion. One of the branched rim water conduits 16 communicates with a first rim water spout 16*a*; the other rim water conduit 16 communicates with a second rim water spout 16*b*.

The jet flushwater tank 34 is disposed at the rear of the flush toilet 30 and below the rim flushwater tank 32. The jet flushwater tank 34 is formed to have a larger capacity than the rim flushwater tank 32. The jet drain valve 14 is provided at the lower portion of the jet flushwater tank 34 in a position lower than the height L1 and higher than the height L2 of the trap pipe 7 apex. The jet drain valve 14 is formed to be larger than the rim drain valve 12. The jet water conduit 18 is formed at the bottom side of the jet drain valve 14; flushwater which has passed through the jet drain valve 14 flows into the jet water conduit 18 and is expelled from the jet hole 6.

Furthermore, a jet tank water supply valve 36 is disposed inside the jet flushwater tank 34. The jet tank water supply valve 36 is constituted to supply flushwater when the water level in the jet flushwater tank 34 reaches a predetermined water level L4 which is set to be lower than the height L1 of the rim section 4 top surface. A water supply pipe 40 extending over the rim flushwater tank 32 so as to traverse the jet flushwater tank 34 is connected to the jet tank water supply valve 36. Flushwater which has passed through the jet tank water supply valve 36 passes through the water supply pipe 40 to reach the upper part of the rim flushwater tank 32 and flows from an outlet port 40*a* into the rim flushwater tank 32.

Next, the operation of the third embodiment flush toilet 30 of the present invention will be explained.

First, in a state in which no flushing operation is being performed, flushwater collects up to the height of the trap pipe 7 apex 7*a* in the flush toilet 30 bowl section 2. Also, flushwater is stored up to a height L3 in the rim flushwater tank 32 and up to a height L4 in the jet flushwater tank 34. Next, when a flush toilet 30 user performs a flushing operation, a drain valve operating mechanism (not shown) respectively raises the beaded chains 12*a* and 14*a*, and each drain valve is opened. The timing at which each drain valve is opened can be freely set by the length of the beaded chains 12*a* and 14*a* and the drain valve operating mechanism.

The bowl section cleaning operation after the rim drain valve 12 and the jet drain valve 14 are opened is similar to the first embodiment; an explanation thereof is therefore omitted.

Next, the supply of water to each of the tanks will be explained.

When the jet drain valve 14 is opened and the water level in the jet flushwater tank 34 drops, a float 36*a* provided on the jet tank water supply valve 36 drops down, the jet tank water supply valve 36 opens, and supplying of water commences. When the jet tank water supply valve 36 opens, flushwater supplied from the water main flows through the water supply pipe 40, out of the water supply pipe 40 outlet port 40*a*, and into the rim flushwater tank 32. Flushwater supplied from the water main first flows into the rim flushwater tank 32; at this point water is not supplied to the jet flushwater tank 34, and the water level in the jet flushwater tank 34 does not rise. When the water level in the rim flushwater tank 32 rises and reaches height L3, the flushwater overflows from the notch 38, so that flushwater flows into the jet flushwater tank 34 disposed under the rim flushwater tank 32. When flushwater begins to flow into the jet flushwater tank 34, the water level in the jet flushwater tank 34 also begins to rise; this is accompanied by an upward movement of the jet tank water supply valve 36 float 36*a*. When the jet flushwater tank 34 water level rises and reaches height L4, the jet tank water supply valve 36 is closed and the supply of flushwater from the water main is stopped, thus completing one flush operation.

While flushwater is being supplied via the jet tank water supply valve 36, a portion of the water passing through the jet tank water supply valve 36 reaches the water supply pipe 40 elongated portion 40*b* and is discharged into an overflow pipe 14*b* without flowing out of the outlet port 40*a*. Flushwater which has entered the overflow pipe 14*b* bypasses the jet drain valve 14 and flows from the jet hole 6 into the bowl section 2. After each of the drain valves has closed, this flushwater is used to restore the water level in the bowl section 2 to the height L2.

According to the third embodiment flush toilet of the present invention, the water levels of the rim flushwater tank and the jet flushwater tank can be set to predetermined water levels by a single water supply valve. Also, in the flush toilet of the present embodiment the water level inside the rim flushwater tank is set by a notch, which is a transfer means; therefore flushwater can be accurately stored up to the set water level without the requirement for supply valve float adjustments, etc.

Figure 8A:
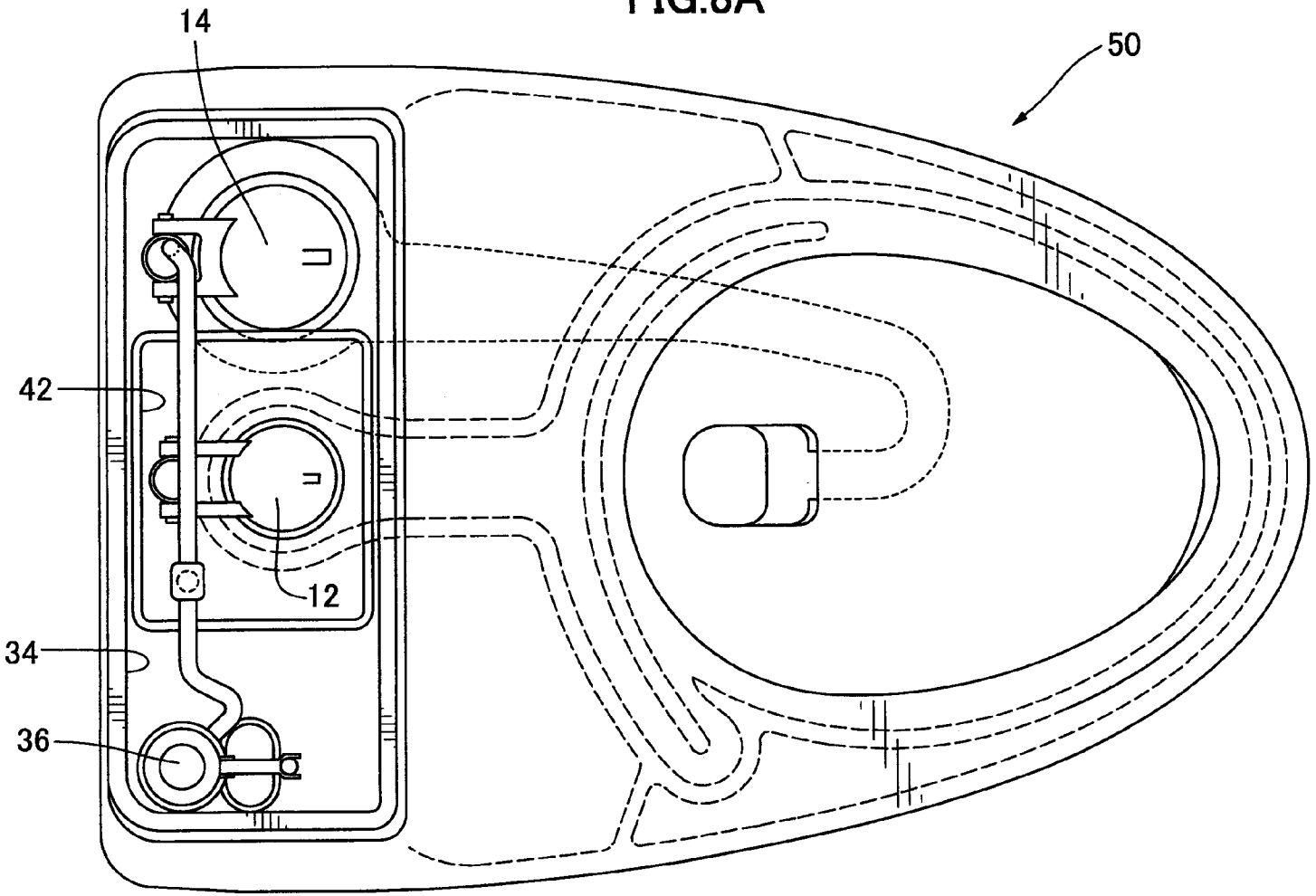
FIG. 8A is a top plan view depicting a variant example of the third embodiment flush toilet of the present invention.
Figure 8B:
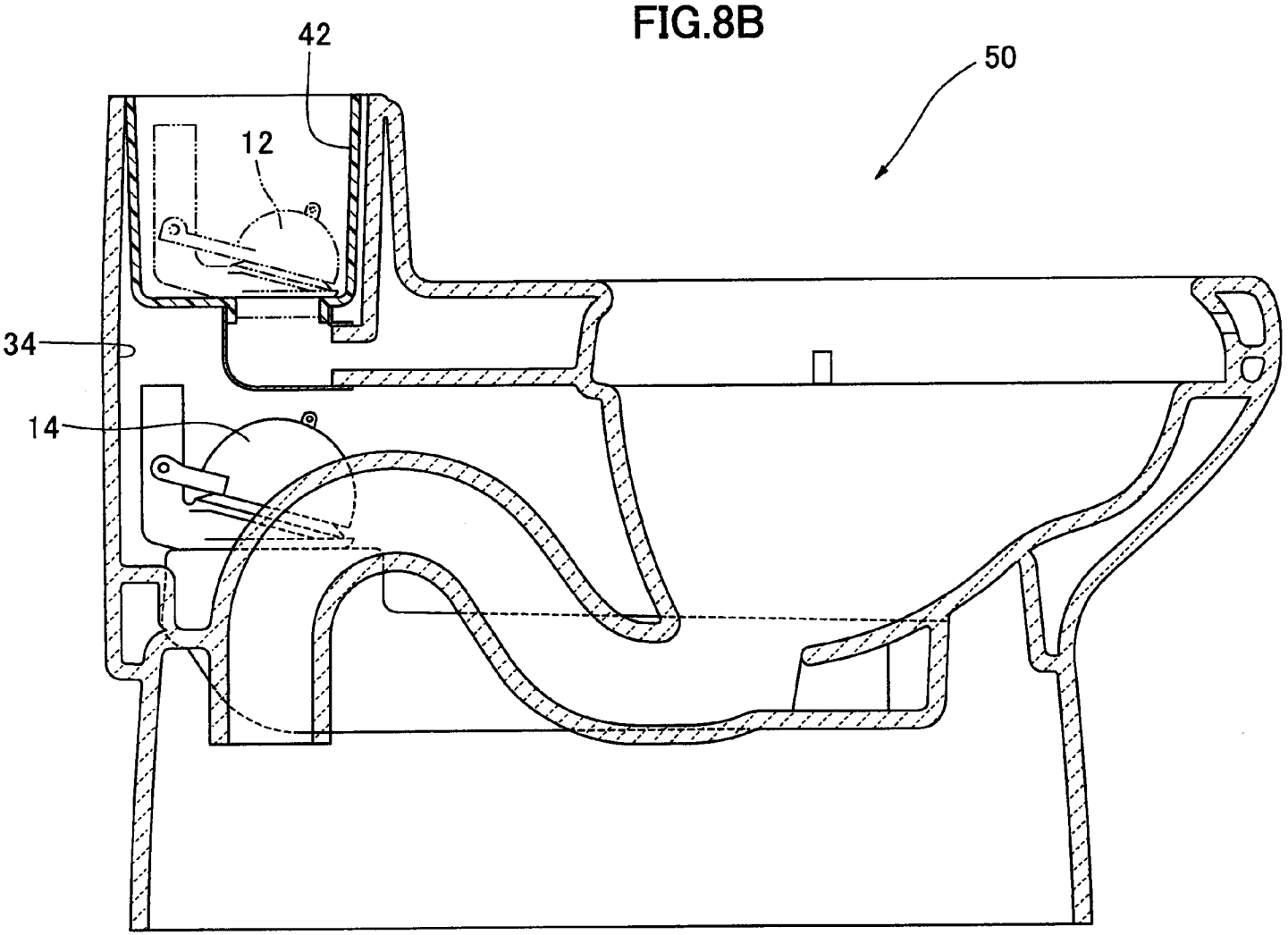
FIG. 8B is a side cross-sectional view depicting a variant example of the third embodiment flush toilet of the present invention.
Figure 8C:
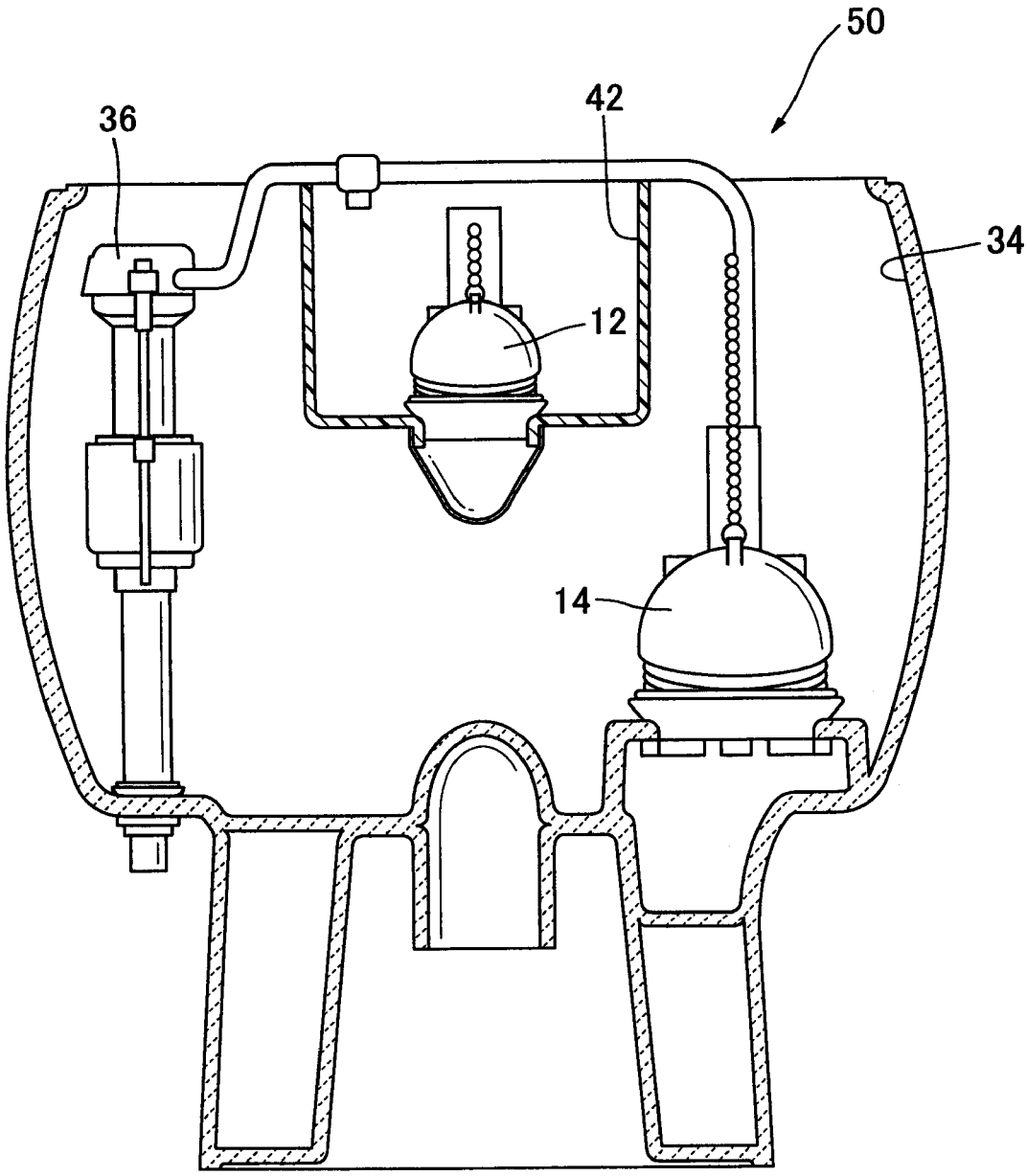
FIG. 8C is a front cross-sectional view depicting a variant example of the third embodiment flush toilet of the present invention.

The rim flushwater tank and jet flushwater tank in the embodiment described above were formed of porcelain, but as a variant the rim flushwater tank and/or the jet flushwater tank could be formed of resin. For example, in a flush toilet 50 shown in FIGS. 8A, 8B, and 8C, the jet flushwater tank 34 is formed of porcelain and a rim flushwater tank 42 is formed of resin. Such a constitution permits the rim flushwater tank 42 to be installed after the jet drain valve 14 and jet tank water supply valve 36, etc. have been set into the jet flushwater tank 34, thus improving the flush toilet 50 ease of assembly.

Furthermore, in the third embodiment described above the rim flushwater tank was disposed directly over the jet flushwater tank and the notch provided in the rim flushwater tank was used as a transfer means, but as a variant the transfer means could also be constituted by a pipe-shaped piece installed to communicate at a predetermined height on the rim flushwater tank side wall. In this constitution, when the water level inside the rim flushwater tank surpasses the height at which the pipe-shaped piece is installed, flushwater passes through the pipe-shaped piece and flows into the jet flushwater tank. In this constitution, extending the end of the pipe-shaped piece to the jet flushwater tank permits the rim flushwater tank to be placed in a position other than directly over the jet flushwater tank.

The invention claimed is:

1. A flush toilet for supplying flushwater from a flushwater tank, the flush toilet comprising:

a bowl section, at the bottom portion of which is formed a jet hole for expelling flushwater;

a jet flushwater tank for storing flushwater to be supplied from said jet hole;

a jet drain valve disposed on the jet flushwater tank for supplying and shutting off flushwater to said jet hole;

a jet water conduit for conducting flushwater which has passed through the jet drain valve to said jet hole;

a rim section disposed on the upper portion of said bowl section for causing flushwater to flow down to said bowl section;

a rim flushwater tank for storing flushwater supplied to said rim section;

a rim drain valve disposed on said rim flushwater tank for supplying and shutting off flushwater to said rim section;

a rim water conduit for conducting flushwater passed through said rim drain valve to said rim; and wherein said rim drain valve is placed in a position higher than the height of said rim section top surface, and said jet drain valve is placed in a position lower than the height of said rim section top surface and higher than said jet hole.

2. The flush toilet according to claim 1, further comprising a water supply valve constituted to shut off the supply of water when the water level inside said jet flushwater tank reaches a predetermined water level set to be lower than the height of said rim section top surface; and wherein said jet drain valve is placed in a position lower than said predetermined water level.

3. The flush toilet according to claim 1, further comprising a transfer means which, when the water level in said rim flushwater tank surpasses a predetermined reservoir height, transfers the portion of the flushwater exceeding said predetermined reservoir height from said rim flushwater tank to said jet flushwater tank; and a water supply valve constituted to supply water to said rim flushwater tank and to stop the supply of water when the water level in said jet flushwater tank reaches a predetermined water level set at a position lower than the height of said rim flushwater tank reservoir height.

4. The flush toilet according to claim 3, wherein said rim flushwater tank is placed at a position higher than said jet flushwater tank, said transfer means is a notch formed at the reservoir height of said rim flushwater tank, and flushwater overflowing from the notch flows into said jet flushwater tank.

5. The flush toilet according to claim 4, wherein said jet flushwater tank and said rim flushwater tank, together with said bowl section, said jet water conduit, said rim section, and said rim water conduit, are constituted as an integral unit of porcelain.

6. The flush toilet according to claim 4, wherein said jet flushwater tank is constituted of porcelain, and said rim flushwater tank is constituted of resin.

7. The flush toilet according to claim 3, wherein said jet flushwater tank and said rim flushwater tank, together with said bowl section, said jet water conduit, said rim section, and said rim water conduit, are constituted as an integral unit of porcelain.

8. The flush toilet according to claim 3, wherein said jet flushwater tank is constituted of porcelain, and said rim flushwater tank is constituted of resin.

* * * * *